US005129484A

United States Patent [19]

Wagner

[11] Patent Number: 5,129,484

[45] Date of Patent: Jul. 14, 1992

[54] TRAVELING DEVICE FOR RAISING OR LOWERING PERSONS OR OBJECTS

[75] Inventor: Kurt Wagner, Wiesbaden, Fed. Rep. of Germany

[73] Assignee: Man Gutehoffnungshutte Aktiengesellschaft, Oberhausen, Fed. Rep. of Germany

[21] Appl. No.: 660,430

[22] Filed: Feb. 22, 1991

[30] Foreign Application Priority Data

Feb. 26, 1990 [DE] Fed. Rep. of Germany ..... 4005997

[51] Int. Cl.[5] ..... B66B 9/20

[52] U.S. Cl. ..... 187/11; 187/8.59; 182/145

[58] Field of Search ..... 187/9 R, 11, 1 R, 27, 187/8.62, 8.59, 62; 182/141, 143, 145

[56] References Cited

U.S. PATENT DOCUMENTS 3,139,266 6/1964 Tew ..... 187/8.59

4,000,789 1/1977 Zahner ..... 182/145

FOREIGN PATENT DOCUMENTS 593448 3/1960 Canada ..... 187/11

*Primary Examiner*—D. Glenn Dayoan
*Assistant Examiner*—Kenneth Noland
*Attorney, Agent, or Firm*—McGlew & Tuttle

[57] ABSTRACT

A traveling device for raising or lowering persons or objects for theater stages or the like has a two-part traveling carriage. The two traveling carriage parts (1 and 2) are connected by lattice girders 3 to form one unit. Elevating platforms 4 of different sizes can be suspended on the cable winches of the traveling carriage parts. The winch frames 9 are telescopic 10. The lowering device is consequently variable in terms of the size of its elevating platform and the lifting height. The modular concept permits easy transportation in the form of individual parts and simple set-up of the lowering device.

4 Claims, 1 Drawing Sheet

A-A 1
2
3
4
5
6
7
8
9
10
11
12
13
A
A

TRAVELING DEVICE FOR RAISING OR LOWERING PERSONS OR OBJECTS

The present invention pertains to a traveling device for raising or lowering persons or objects, especially for theater stages, comprising an elevating platform that can be raised and lowered by means of cables.

BACKGROUND OF THE INVENTION

The floors of theater stages have floor sections that can be lowered and displaced and serve the purpose of exposing openings in the stage floor in order to permit persons, objects, etc., to disappear or appear at this point. Such floor sections, also called trap doors, which are integrated within the stage, flush with the floor, are displaced, individually or in groups, on rail-like guides by means of rollers or skids in a coordinated manner. According to a more recent suggestion, the traveling stage floor section is mounted to one side on the stage structure and is swiveled for opening and closing by means of an actuating member, which acts on the underside of the movable section.

For appearances from below or exits from above, lowerable platforms, so-called elevating platforms, on which persons or the like are raised to the stage level or lowered to the level of the stage basement, are positioned under the stage floor opening provided.

Lifting devices for elevating platforms, which are designed according to the principle of the forklift, are known. In these designs, it is necessary to build up an additional scissors-like structure to bridge over the distance between the maximum lifting heiqht and the stage level. The shears or scissor-like elements can be extended and retracted manually or by means of a motor drive. The floor of the lowering platform has a defined area, to which the traveling carriage of the device is adapted.

It is therefore necessary to provide a plurality of lowering devices with platforms of corresponding area dimensions for stage floor openings of different sizes.

As a consequence of the measures resulting from the design principle, such lowering systems weigh about 1 ton in the case of platform sizes of approximately 1×1m and a payload of approximately 2,000 Newton. This weight causes difficulties in terms of the handling of the device.

SUMMARY AND OBJECT OF THE INVENTION

It is an object of the present invention to provide a lowering device for theater stages, which is versatile, i.e., it is movable and also the lifting height of the elevated platform is variable, but which especially can be equipped with elevating platforms of different sizes. Furthermore, the device shall be able to be bolted into an existing stage substructure similarly to a stationary lowering device.

According to the invention, a travelling device, particularly for bigger and varied gauges is provided for raising or lowering persons or objects. The device comprises a platform that can be raised and lowered by means of cables. The travelling carriage includes a winch frame for suspending and elevating a platform on cables. The arrangement includes a two part frame structure for receiving elevating platforms of different sizes. The frame parts are bolted together via lattice girders wherein one travelling carriage frame part contains a drive for control of the winch device of each of the two travelling carriage parts. The rotary movement is transmitted to the winches on the winch frames, from the drive by means of a Cardan shaft of variable length. The Cardan shaft can be inserted in either direction. The winch frames include telescoping members for setting different lifting heights of the elevating platform.

The traveling carriage of the device according to the present invention consists of two parts and permits elevating platforms of different size to be suspended in it. For example, platform sizes of 1×1m, 2×1m, 3×1m, 4×1m, etc., are common.

The payload, which consists of persons or objects to be raised or lowered, and which is able to accommodate the transport and hoisting means according to the present invention, is 10 kNewton (static load) and 5 kNewton (dynamic load) in the case of a platform size of, e.g., 1×2m.

One particular advantage of the device according to the present invention is that it is designed as a modular system, i.e., it is easy to transport and install in the form of individual parts of low weight.

The device according to the present invention is usually installed in the stage basement of a theater, and the telescopic roller holders of the winch frames are bolted into an existing stage substructure by means of brackets. Most of the cable forces are introduced directly into the stage substructure.

The device according to the present invention can also be used as a stand-alone device on the theater stage within a decoration.

A further object of the invention is to provide a modular raisable and lowerable platform arrangement which is simple in design, economical to manufacture, rugged in construction and durable and stable when assembled.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figures 1, 2:
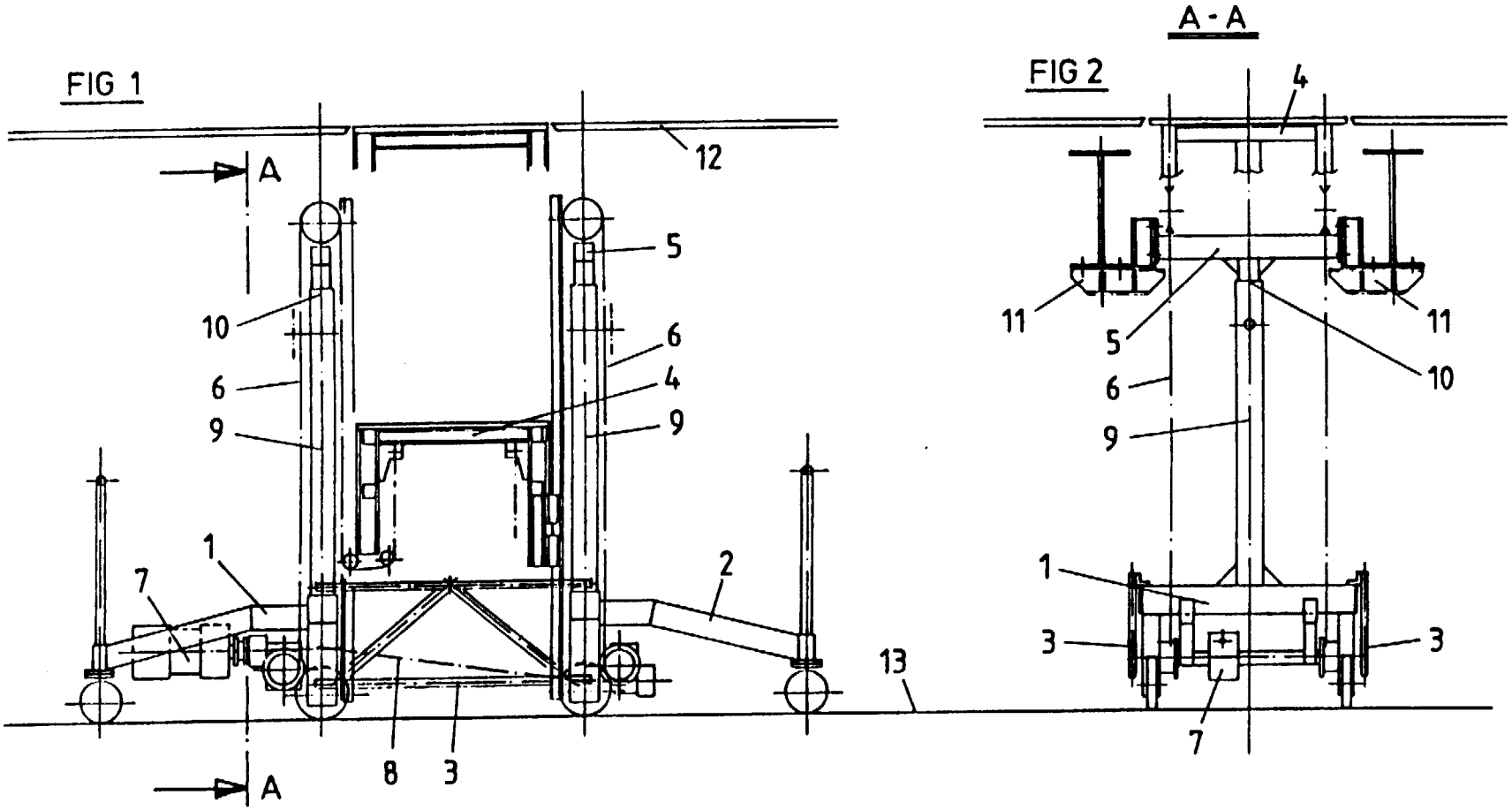
FIG. 1 is a vertical sectional view showing a lowering device according to the invention.
FIG. 2 is a sectional view taken along line II—II in FIG. 1.

Referring to the drawings in particular, the invention provides a platform lowering device that can be moved on wheels and which may be positioned on the floor of the stage basement 13. The two traveling carriage parts 1 and 2 with the two winch frames 9 are bolted together via two lattice girders 3 to form one unit. The lowering device usually has no traveling drive mechanism, but is moved manually.

The elevating platform 4 is suspended on cables 6 of the winches. The winch drive 7 is located on the left-hand part 1 of the traveling carriage according to FIG. 1. The rotary movement is transmitted to the winch of the right-hand traveling carriage part 2 via a Cardan shaft 8 that can be inserted on both sides.

As is apparent from FIG. 2, the upper telescopic roller holders 5 of the upper telescopic part 10 of the winch frames 9 are bolted into the stage substructure via brackets 11. As a consequence, the cable forces are essentially introduced directly into the stage substructure.

The telescopic parts 10 of the winch frames 9 are advantageously pulled up by means of load bars (so-called pullers), which are arranged above the theater stage and are then fixed on the brackets 11.

The ability of the winch frames to telescope thus permits adaptation to the actual height of the stage basement and permits variable lifting height of the elevating platform.

The elevating platform 4 is raised and lowered by means of the winches. During lowering, the elevating platform 4 dips down between the two lattice girders 3.

Stair members consisting of several steps (not shown) can be arranged at the long sides to grant access to the elevating platform.

The lattice girders 3 also serve as guard rails, with which the space under the raised elevated platform is blocked off.

The two-part design of the traveling carriage of the lowering device makes it possible to suspend elevating platforms 4 of different sizes. The distance of the traveling carriage parts 1 and 2, which changes as a result, requires correspondingly adapted distances for the lattice girders 3 and a Cardan shaft 8 adjusted to the corresponding distance.

The lowering device is transported, e.g., from one place on the floor of the stage basement to the theater stage, in individual parts, which are easy to transport as a consequence of their relatively low weight. The lowering device is reassembled at the new site in a simple manner as a consequence of the modular design, especially because the individual parts are easy to handle and can be mounted in a simple manner.

While a specific embodiment of the invention has been shown and described in detail to illustrate the application of the principles of the invention, it will be understood that the invention may be embodied otherwise without departing from such principles.

What is claimed is:

1. A modular travelling device for raising or lowering persons or objects, especially for theater stages, comprising:

a first travelling frame part and a second travelling frame part;

lattice girders having a length selected for connecting said first travelling frame part and said second travelling frame part to define a spacing which is variable in dependence upon said length selected;

a first winch frame associated with said first travelling frame part and a second winch frame associated with said second travelling frame part;

a drive connected to said first travelling frame part;

a Cardo shaft connecting said drive with a winch device of said second winch frame to transmit rotary motion from said drive to said winch device of second winch frame;

telescoping means associated with each of said winch frames for setting different lift heights of said winch frame; and an elevating platform positioned between said winch frames and connected to said winch devices of each of said first and second winch frames, said length being selected in dependance upon a length dimension of said platform, said platform being suspended by cables connected below a platform surface of said elevating platform and connected to said winch device of each said winch frame for raising and lowering said elevating platform for raising a platform surface above said winch frame.

2. A travelling device according to claim 1, wherein each of said winch frames include upper roller holders including attachment means for attachably connecting said upper roller holders to a theater stage substructure.

3. A modular travelling device for raising or lowering persons or objects, especially for theater stages, comprising:

a first travelling frame part and a second travelling frame part;

lattice girders connecting said first travelling frame part and said second travelling frame part to define a spacing;

a first winch frame associated with said first travelling frame part and a second winch frame associated with said second travelling frame part and connected to a first travelling frame part winch device;

a drive connected to said first travelling frame part;

a Cardon shaft connecting said drive with a second winch frame winch device to transmit rotary motion from said drive to said second winch frame winch device;

telescoping means associated with each of said winch frames for setting different lift heights of said winch frame; and an elevating platform positioned between said winch frames and having a support extending downwardly of a platform surface, said support being connected to said winch devices of each of said first and second winch frames via cables for raising said platform surface above said first winch frame and said second winch frame, said platform having a length dimension determining said spacing, said lattice girders having a length and said Cardon shaft having a length selected in dependance upon said spacing.

4. A modular portable trap door structure for theater stages, comprising:

a first travelling frame part and a second travelling frame part;

an elevating platform disposed between said travelling frame parts and having a length dimension determining a spacing between said travelling frame parts;

lattice girders connecting said first travelling frame part and said second travelling part, said lattice girders having a length selected in dependence upon said platform length;

a first winch frame associated with said first travelling frame part and a second winch frame associated with said second travelling frame part;

a drive connected to said first travelling frame part;

transmission means connecting said drive with a winch device of said second winch frame for transmitting rotary motion from said drive to said winch device of said second winch frame;

telescoping means associated with each of said winch frames for setting different lift heights of said winch frames, said elevating platform being connected to winch devices of each of said first and second winch frames and being suspended by cables by connected to a winch device of each winch frame for raising and lowering said elevating platform; and means for attachably connecting said winch frames to a theater stage substructure.

* * * * *